United States Patent [19]

Kovar

[11] 4,098,384

[45] Jul. 4, 1978

[54] TOKEN ACTUATABLE VEND MECHANISM

[75] Inventor: Henry Charles Kovar, Anoka, Minn.

[73] Assignee: The Cornelius Company, Minneapolis, Minn.

[21] Appl. No.: 740,643

[22] Filed: Nov. 10, 1976

[51] Int. Cl.[2] ..... G07F 3/06

[52] U.S. Cl. ..... 194/37

[58] Field of Search ..... 194/1 L, 4, 2, 48, 51, 194/1 K, 37; 221/150 B

[56] References Cited

U.S. PATENT DOCUMENTS

| | | | |
|---|---|---|---|
| 2,718,352 | 9/1955 | Nicolaus | 194/1 K X |
| 3,139,167 | 6/1964 | Wittern | 194/48 XX |
| 3,163,328 | 12/1964 | Cornelius | 221/150 R X |

*Primary Examiner*—Stanley H. Tollberg
*Attorney, Agent, or Firm*—Henry C. Kovar

[57] ABSTRACT

A coin operable vend mechanism has a frame, a token counter mounted on the frame, a vend release mechanism mounted on the frame and operably connected to the token counter, and a token acceptor removably mounted in the frame and atop of the token counter; the token acceptor has an internal token identifying structure and a return for improper tokens and is held in the frame by a tongue and groove structure which is held together by a lock which is accessible only when the mechanism is removed from a vending machine; the token counter and vend release mechanism are both attached to the frame by common mounting structure.

26 Claims, 5 Drawing Figures

TOKEN ACTUATABLE VEND MECHANISM

BACKGROUND OF THE INVENTION

1. Field of the Invention

This invention pertains to a construction of a token operable vend release mechanism.

2. Prior Art

This invention is specifically intended for use in the vending machine described and claimed in U.S. Pat. No. 3,163,328. Specific examples of prior art token operable vend release mechanisms for this vender are described and claimed in R. T. Cornelius U.S. Pat. No. 3,197,007 and in my U.S. Pat. Nos. 3,185,282; 3,225,880; and 3,372,864. All of these devices have been commercialized in the United States.

One of the problems with the preceding mechanisms is that they had limited pricing capabilities and as inflation took its toll on the price of soft drinks, the price at which soft drinks and other packaged beverages were sold at increased and became higher than the pricing capabilities of the prior art. Price fluctuation has also become a considerable problem; a vending machine operator may now have to change prices up or down every few months as his costs and/or market supply and demand vary. While the prior art mechanisms did offer some capability of price changing, they have been found insufficient in this respect in an inflationary economy or in a period of changing costs.

The prior art devices mentioned had a capacity to accommodate two different coins; specifically the nickel and dime. It has been found necessary that three coins, specifically the nickel, dime and quarter now be accommodated for the vending of soft drinks.

The prior art devices had a structure which was a permanent type assembly; it has been found that when there was a failure of some component within the mechanism that the entire mechanism would have to be returned to a service center or factory for repair.

Complication of coin and vending mechanisms has always been a problem, and integration of the various structures for vending, releasing the vend, counting the tokens, and identifying proper tokens and rejecting improper tokens has always produced a reasonably complicated mechanical structure.

Every person working with coin handling equipment is well aware of the present trend to electronic coin identification, counting and vend release. However, there still is a great utility for mechanical and non-electrical devices provided that they are not complicated, are extremely reliable, have the necessary pricing capability and are easily serviceable in the event of a failure, pilferage or destructive vandalism; and are of a reasonable cost to the vending machine operator.

SUMMARY OF THE INVENTION

In accordance with this invention, a vending mechanism is provided having a frame and a token counter mounted in the frame; distinct aspects of the invention include a token accepting cover mounted and locked in the frame and atop of the token counter, the cover being unlockable and removable from the frame while the token counter remains operative, and a single mounting structure for attaching both the token counter and a vending control structure to the frame.

Accordingly, it is an object of the present invention to provide a vending mechanism having common attachment structure for mounting both a token counter and a vend mechanism controlled by the counter to a frame of the mechanism.

It is an object of the present invention to provide a token accepting mechanism having a rigid frame and a removable token acceptor held in the frame by an easily accessible and operable lock.

It is another object of the present invention to provide a token accepting vend mechanism having a token counter and a vending release, and a token acceptor removable from the mechanism while the counter and release remain operative.

It is a further object of the present invention to provide a structure for retaining and locking a token acceptor in a mechanism frame.

Yet a further object of the present invention is to provide a token actuatable vend mechanism which is mountable in its entirety in a vending machine and has a token acceptor locked to mechanism; with the acceptor being unlockable from the mechanism when the mechanism is out of the vending machine.

Another object of the present invention is to provide a vending mechanism having interoperative token acceptor, token counter and vend control mechanisms which are separately and easily serviceable.

Still another object of the present invention is to provide a token mechanism having easily changeable pricing for vend control and release.

Many other advantages, features and additional objects of the present invention will become manifest to those versed in the art upon making reference to the detailed description and the accompanying sheets of drawings in which a preferred structural embodiment incorporating the principles of the present invention is shown by way of illustrative example.

IN THE DRAWINGS

AS SHOWN ON THE DRAWINGS

Figure 1:
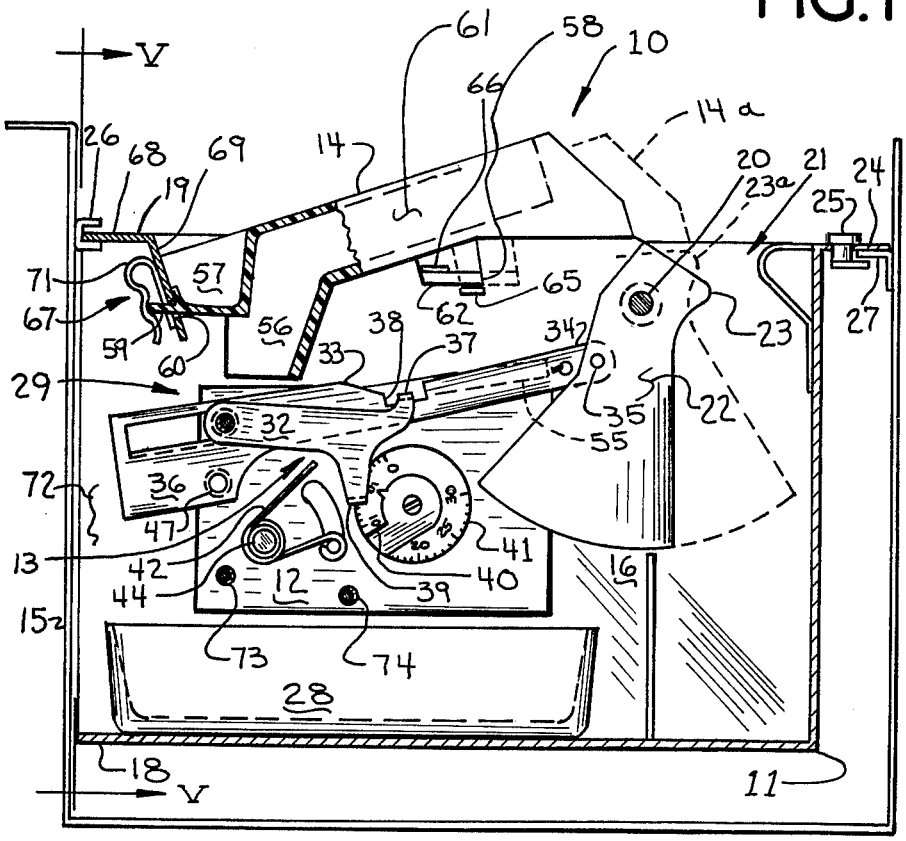
FIG. 1 is a side elevational view in partial section of the preferred embodiment of a token actuatable vend mechanism provided in accordance with the present invention.

The principles of the present invention are particularly useful when embodied in a token operable mechanism of the type illustrated in FIG. 1 and generally indicated by the numeral 10. The mechanism 10 includes a frame 11, a token counter 12 mounted to the frame 11, a vend release generally indicated by 13, and a token acceptor 14 mounted in the frame 11 and atop of the token counter 12. The mechanism 10 is specifically intended to be placed and locked in a vending machine cabinet 15, such cabinet being of the type shown in U.S. Pat. No. 3,163,328.

The frame 11 is formed of sheet metal and has an upright rear side panel 16 and an upright front side panel 17, both of which are elongated along the length of the mechanism 10. The side frames 16 and 17 are parallel to each other and spaced from each other and are rigidly connected together by a sheet metal bottom 18, a rigid sheet metal end panel 19 and a vend door shaft 20. In one end of the frame 11 there is a vending means, generally indicated by the numeral 21, which in the embodiment shown is specifically for a beverage bottle and has a vend door 22 which has an abutment 23 which normally precludes withdrawal of a bottle and which is movable to an alternate position 23*a* for opening of the vending means 21 and releasing a bottle. The vending means 21 may be for a different type of package, examples of which are cans, cigarettes, food packages and the like, and the vend door 22 may have a handle (not shown) which a customer may pull or push to make the vending means 21 move for releasing a package to be vended. There are many types of mechanical vending releases besides the one shown and described herein, and many of these are usable in the confines of frame 11 rather than the illustrated vend door 22.

There is a lip 24 extending off from the frame 11 and there is a frame lock 25 in the lip 24. The cabinet 15 has a front bracket 26 and a rear bracket 27. The end panel 19 fits into front bracket 26 and the lip 24 rests atop the rear bracket 27 and the frame lock 25 turns underneath the rear bracket 27 to retain the mechanism 10 within the vender cabinet 15. A coin box 28 sits upon the frame bottom 18 and receives counted tokens from the token counter 12.

Figure 5:
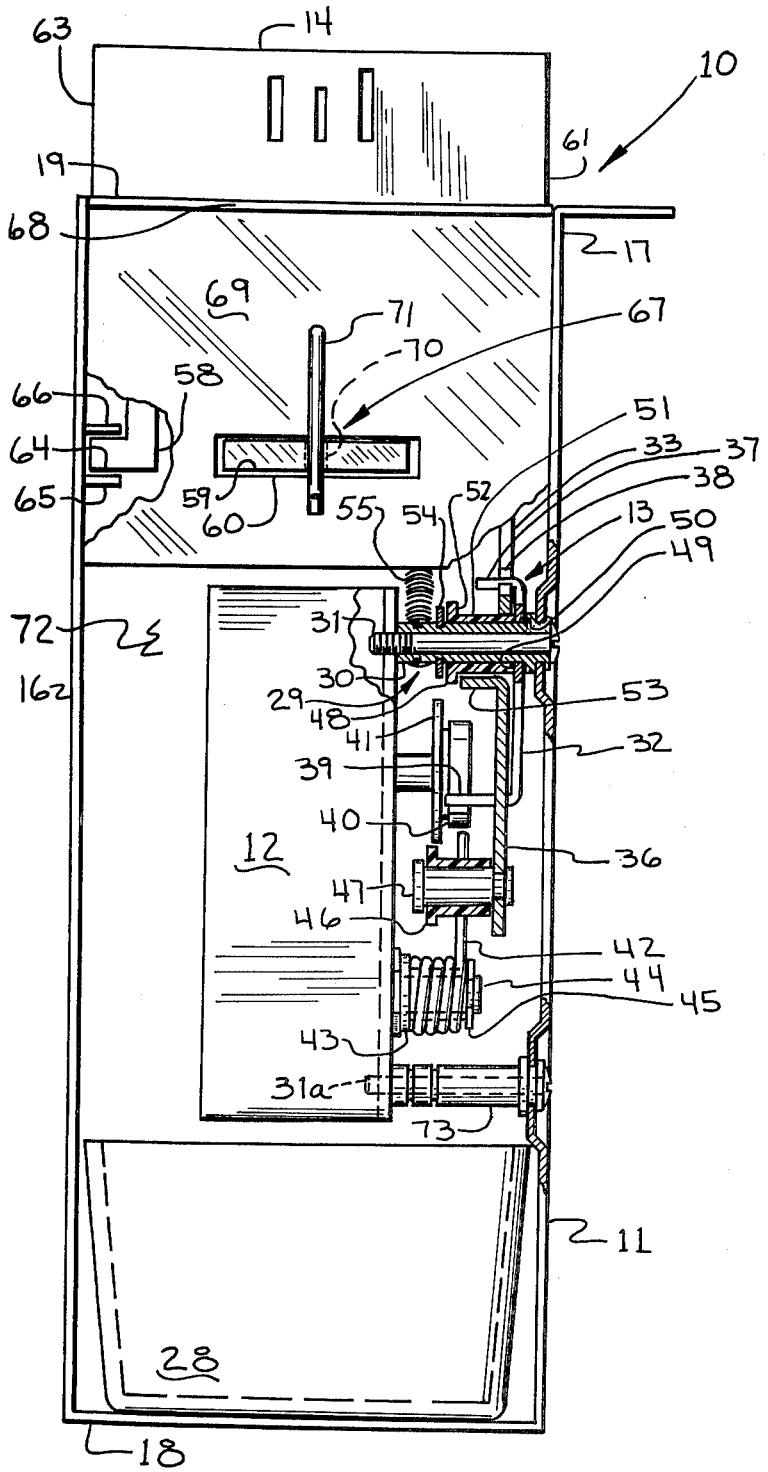
FIG. 5 is an end view taken along lines V—V of FIG. 1 with part of the vend release being shown in section.

The token counter 12 is located within the mechanism 10 and between the frame side panels 16 and 17. The token counter 12 is secured to the front side panel 17 by mounting means generally indicated by the numeral 29 and best seen in FIG. 5. The mounting means 29 includes a hollow tubular column 30 rigidly attached to front side panel 17. The column 30 is of a precise length and holds off and precisely locates the token counter 12 from the front side panel 17. There is a fastener 31, a screw being shown, extending through the inside of the column 30. The screw is driveably accessible from the outside of the mechanism 10 and as shown, extends entirely through the column 30 so that the screw head is accessible on the outside of the mechanism 10, and the threaded end of screw 31 is driven into the token counter 12 to tightly hold the counter 12 against the column 30.

The vend release 13 is also attached to the front side panel by the mounting means 29. The vend release 13 includes a vending lock 32 and a slide bar 33, both of which are operatively mounted upon the column 30. The slide bar 33 has a remote end 34 which is operatively connected to the vend door 22 by a clevis 35, and also has a tail end 36 which is slideably mounted on the outside of the column 30. The vend lock 32 is rotatably mounted on the column 30. The vend lock 32 has a latch 37 which hangs in a notch 38 of the slide bar 33. When a person attempts to open the vend door 22, the slide bar 33 is pulled toward the vend door 22 and the slide bar notch 38 engages the lock latch 37 and prevents the vend door 22 from opening. The vend lock 32 also has a cam follower 39 which is operably engageable by an output cam 40 on the token counter 12. The output cam 40 is shown in FIG. 1 and as seen therein, rotates clockwise as tokens are counted. The output cam 40 is mounted on a price wheel 41 and is rotationally indexed with respect to the price wheel 41 to give a predetermined vend price. The output cam 40 is fastened to the price wheel 41 by a screw, the head of which can be seen centrally in the price wheel 41. The price wheel 41 has a series of numbers stamped thereon; the numbers "0, 5, 10, 20, 25 and 30" are illustrated. The output cam 40 has a pointer which is shown pointing toward the number "5" on wheel 41. These numbers indicate the vend price and each unit in the number represents 5 cents in the vend price; specifically, the number "5" represents a 25 cent price, the number "10" a 50 cent price and so on. The owner may determine and set the vending price by loosening the screw and indexing the cam 40 with respect to the wheel 41 and tighten the screw to fix the index.

The illustrated token mechanism 12 shown is a device manufactured and sold by National Rejectors, Inc. of Hot Springs, Arkansas, and is referred to by them as being their "SCS" or Simplified Credit System mechanical accumulator. This particular mechanical accumulator is the subject of U.S. Pat. No. 3,155,213 and the structure and operation of this accumulator is elaborated upon in that patent.

When tokens (not shown) pass through the token counter 12, the price wheel 41 and output cam 40 simultaneously and together turn clockwise as seen in FIG. 1 until the output cam 40 engages the cam follower 39, turns the vend lock 32 rotationally upward around the column 30 and lifts the vend lock latch 37 out of the slide bar notch 38. When the vend lock 32 is in this lifted position, the vend door 22 can be pulled open and the slide bar 33 is free and follows the vend door 22 through a complete range of travel for operatively opening the vend means 21 and discharging an item to be vended.

During the opening of vend door 22 and the reciprocal pulling out of the slide bar 33, the token counter 12 is rewound to a zero position to erase the credit used for the vend. The token counter 12 has a rewind spring 42 which is carried on a plastic bearing 43 rotatably mounted on a shaft 44 and retained by an E-ring 45. For engaging and actuating the rewind spring 42, there is provided a freely rotatable plastic bearing 46 rotatably mounted on a pin 47 which is attached to the tail end 36 of the slide bar 33. As the slide bar 33 is pulled and travels through its normal operative range, the bearing 46 also travels and engages the rewind spring 42 which in turn rewinds the token counter 12.

Referring again to FIG. 5, the tubular column 30 has a freely rotatable plastic bearing 48 which holds the vend lock 32 in place and also serves to guide the slide bar 33. The bearing 48 has an end thrust surface 49 retaining the vend lock 32 against a shoulder 50 of the column 30, and a radial thrust surface 51 and end thrust surface 52 which engages the slide bar 33. The slide bar 33 has a thrust flange 53 to increase the area presented against the bearing 48. The bearing 48 is retained in place on the column 30 by an E-ring 54 and at the inner end of the column 30, a return spring 55 is attached. The other end of the return spring 55 is hooked onto the remote end 34 of slide bar 33 and this return spring 55 reciprocably retracts both the slide bar 33 and the vend door 22 after a vend cycle.

Besides the tubular column 30 of the mounting means 29, there is also provided a support 73 and a support 74 for fastening of the token counter 12 to the frame 11. Each of the supports 73 and 74 is a column identical to column 30 and each has a fastener 31*a* identical to the screw 31. Further simplifying the mechanism 10 and reducing its cost, the three plastic bearings 43, 46 and 48 are identical and interchangeable, and the E-rings 45 and 54 are identical and interchangeable.

One of the important features of this invention is the provision of an easily removable token acceptor 14 in the mechanism 10. The token acceptor 14 includes within its interior, a token or coin identification and rejection structure for directing proper tokens or coins down a chute 56 and into the token counter 12, and for directing improper coins or tokens to a coin return tray 57. The structure and operation of the validation, delivery, rejection and return features of token acceptor 14 are fully disclosed and the operation thereof explained in my U.S. Pat. No. 3,981,384. One of the subjects of the present invention is the securement of such a token acceptor or its operative equivalent into the mechanism 10.

The token acceptor 14 is the cover of the mechanism 10 and is mounted in the frame 11 directly atop of the token counter 12. The token acceptor 14 has a pair of tongues 58 which each engage one of the front and rear side frames 16, 17. At the rear of the token acceptor 14 there is a rear tongue 59 which, when the acceptor 14 is in position in the frame 11, projects through a groove 60 in the rigid end panel 19.

The token acceptor or cover 14 has on a first or front side 61 a tongue 62 and on the cover second or rear side 63 there is a similar tongue 64. In each of the front and rear side frames 16, 17, there is a groove structure formed between an inner retainer 65 and an outer retainer 66; the retainers 65 and 66 are spaced one above and one behind the other as is shown.

When the cover 14 is to be placed in the frame 11, the cover 14 is initially lowered into the frame 11 at a position shown in dotted lines in FIG. 1 and identified as **14*a*. When the cover 14 is in the position 14*a* the tongues 62, 64 are resting on top of the inner retainers 65 and the end tongue 59 is hanging free of the end groove 60. The cover 14 is then slid rearward in and along the length of the frame 11 from the position indicated by 14*a* and the end tongue 59 goes into the end groove 60 and each of the side tongues 62, 64 goes under the outer retainer 66 and the cover 14 is then held firmly in the frame 11 so that the cover 14 cannot go up or down or further rearward in the frame 11. In this position the tongues 62, 64 are within the grooves formed by the retainers 65, 66. It should be appreciated that reversal of the tongue and groove may be desirable if different materials were used in the construction of the mechanism 10. The tongues 59, 62, 64 could be in the frame 11 and the groove 60 and retainers 65, 66 could be in the cover 14. When the cover 14 is in its normal position as shown in FIG. 1, the coin return tray 57 butts up against the frame end panel 19 and the panel 19 actually forms part of the coin return as well as serving as a frame member and also positioning the cover 14 along the length of the frame 11**.

Figure 4:
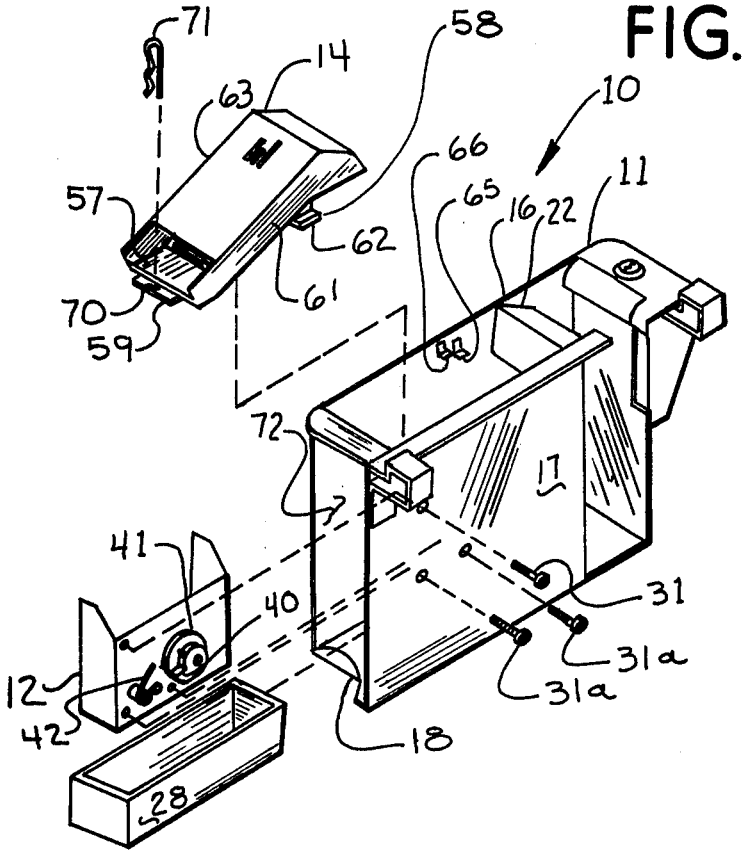
FIG. 4 is an exploded view of the structure of FIG. 1.
Figure 3:
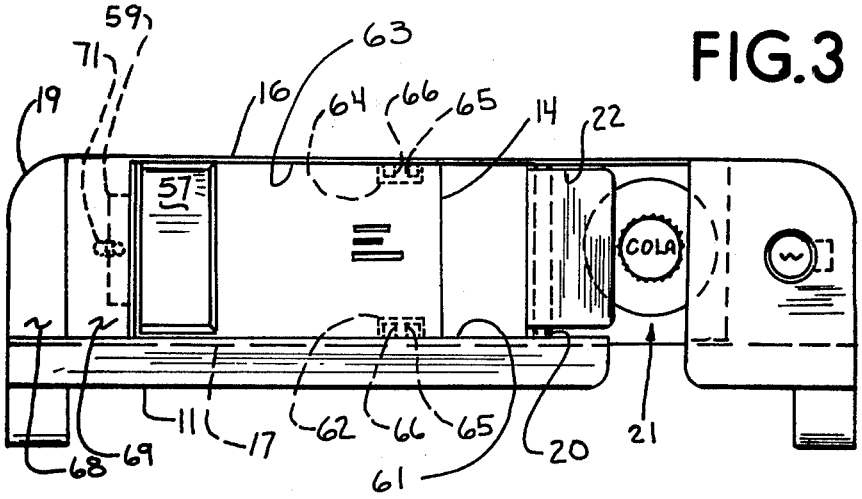
FIG. 3 is a top view of the structure of FIG. 1.

There is provided a means for locking the cover or token acceptor 14 into the frame 11, these lock means being generally indicated by the numeral 67. As is shown, the frame end panel 19 has a flat upper flange 68 and a downward projecting flange 69. The cover end tongue 59 projects through the groove 60 in the downward flange 69 and the tongue 59 is shielded by and is under the upper flange 68 and most of the downward flange 69. The cover end tongue 59 has a pin holder aperture 70, as seen in FIG. 4, through which a cross pin 71 is insertable. The cross pin 71 as seen installed in FIG. 1, is a spring pin which retains itself on and in the cover end tongue 59. The spring pin 71 is manually graspable between the thumb and first finger of a person and is manually removable and installable when and only when the mechanism 10 is out of the vender cabinet 15.

The cover lock means 67 and specifically the pin 71 is normally protectively enclosed and is accessible only when the mechanism 10 is removed from the cabinet 15. The frame sides 16, 17, frame end panel 19 and frame bottom 18 jointly define a rear access port 72 which is completely covered by the cabinet 15 when the mechanism 10 is in place in the cabinet 15. When the mechanism 10 is removed, the access port 72 is completely open and the cover lock means 67 may be manually rendered inoperable by removal of the pin 71 which in turn releases the cover 14 to slide forward in the frame 11 for removal of the cover 14.

Figure 2:
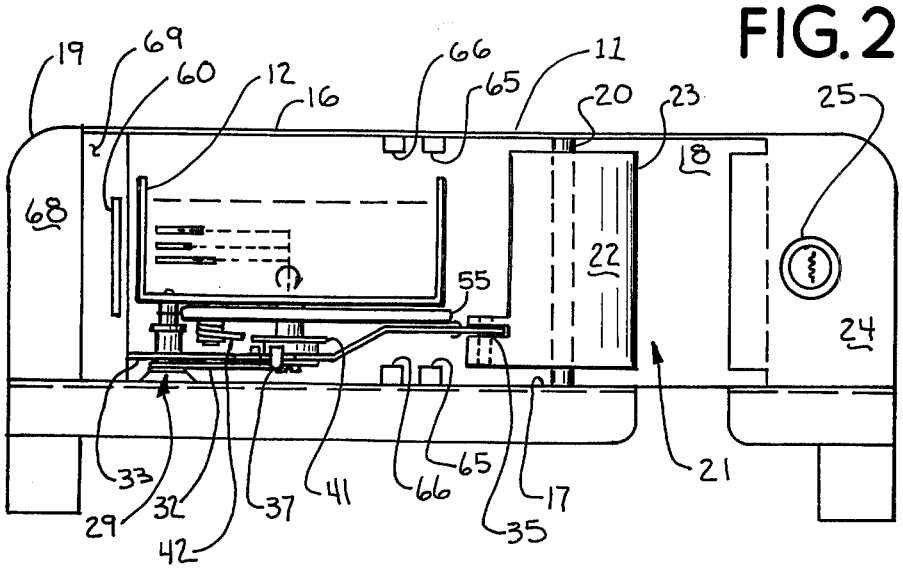
FIG. 2 is a top view, with the token acceptor removed, of the structure of FIG. 1.

The cover or token acceptor 14 is thus slideable in the frame 11 and atop of the token counter 12 to the position **14*a* wherein the cover 14 is then upwardly removable from the frame 11. Then the cover 14 is removed, the entire internal mechanism, namely the vend release 13, and token counter 12 is fully exposed as is best seen in FIG. 2 and these mechanisms remain fully operable and their operation and structural integrity can be visually ascertained when the cover 14** is thus removed.

It should also be noted that the coin box 73 is removable from the access port 72 when the mechanism 10 is removed from the cabinet 15. When both the cover 14 and coin box 73 are removed, operation of the vend release 13 and token counter 12 can be visually inspected from top and rear, and also lower vantage points.

The token counter 12 is removable from the mechanism 10 by unfastening of the screws 31 and the token counter normally is withdrawn out of the access port 72 but may be withdrawn upwardly through the top of frame 11 when the cover 14 is removed. The token counter 12 is removed from the frame 11 when the vend price needs to be changed and access to the price wheel 41 and output cam 40 is required.

When the token counter 12 is removed, the vend release 13, including the slide bar 33, vend lock 32 and return spring 55 all remain operative and the operation of these components may be manually inspected in operation by manually over-riding the vend lock 32 and then opening the vend door 22.

In the use of the mechanism 10, its new structure as herein explained has many great advantages. It is a fact of life, for better or worse, that vending machines are subjected to physically damaging vandalism, outright robbery and the pranks of juveniles.

Specifically, the things that the present mechanism 10 may be expected to be subjected to include attack with devices such as pry bars on the vend door 22 and also between the frame 11 and the cabinet 15; the cover 14 will be beaten upon by a hammer until broken or else pried out with a pry bar and juveniles will open a bottle of soft drink and pour it on, over and into the mechanism 10. In the illustrated mechanism the cover 14 and the enclosed coin identification feature can be completely replaced by anyone; a service man is not required. If the vend release 13 is structurally damaged, there will be no damage to the token counter 12 and the slide bar 33 and vend lock 32 may be replaced. The cover 14 and token counter 12 can be easily taken out for washing to remove dried soft drink, dirt and/or any other debris. Further, this mechanism 10 offers easily changeable vend prices which graduate from free vend to $1.50 in 5-cent increments and the mechanism accepts nickels, dimes and quarters and then also returns pennies and any improper coin to the coin return tray 57. The mechanism 10 is completely mechanical and requires no electricity for its operation and is ideally suited for low cost vending machines. Further the mechanism 10 makes great use of common parts and requires a minimal inventory of spare parts.

Although various minor modifications may be suggested by others versed or experienced in the art, it should be understood that I wish to embody within the scope of the patent warranted hereon, all such embodiments as reasonably and properly come within the scope of my contribution to the art.

I claim as my invention:

1. A token operable vending mechanism comprising:
(a) a frame;
(b) means in the frame for vending a goods;
(c) common mounting means fixed on and to the frame for mounting both of a token counter and a vending lock to the frame;
(d) a mechanical vending lock operatively mounted upon the common mounting means;
(e) a slide bar operatively connecting the vending lock to the vending means, the slide bar being lockable by the vending lock for rendering the vending means inoperable;
(f) a token counter rigidly mounted to the common mounting means; and
(g) a mechanical output means on the token counter, the output means being operable upon the vending lock for rendering the vending lock inoperable and releasing the slide bar, thereby making the vending means operable for release of a goods from the mechanism.

2. A mechanism according to claim 1, in which the mounting means is a hollow tubular column rigidly fixed to the frame, the vending lock being mounted about the column and the token counter being secured against the column by a fastener extending through the inside of the column.

3. A mechanism according to claim 2, in which the fastener is a screw extending completely through the column.

4. A token operable vending mechanism comprising:
(a) a frame;
(b) means in the frame for vending a goods;
(c) mounting means fixed on the frame for mounting a token counter and a vending lock to the frame;
(d) a vending lock rotatably and operatively mounted upon the mounting means;
(e) a slide bar reciprocably and slidably mounted upon the mounting means and operatively connecting the vending lock to the vending means, the slide bar being lockable by the vending lock for rendering the vending means inoperable;
(f) a token counter rigidly mounted to the mounting means; and
(g) a mechanical output means on the token counter, the output means being operable upon the vending lock for rendering the vending lock inoperable and releasing the slide bar, thereby making the vending means operable for release of a goods from the mechanism.

5. A mechanism according to claim 4, including a bearing rotatably mounted upon the column, the bearing having both radial and end thrust surfaces for engaging the slide bar.

6. A mechanism according to claim 5, in which the bearing also has an end thrust surface for retaining the vend lock on the column.

7. a mechanism according to claim 5, including a bearing rotatably mounted on the slide bar for engaging and driving a rewind on the token counter, the bearings being identical to each other.

8. A mechanism according to claim 4, including a return spring for the vend mechanism, the return spring having one end attached to the slide bar, and a second end attached to the mounting means.

9. A mechanism according to claim 1, including at least one token counter support in the frame, said counter support being identical in structure to said mounting means.

10. A mechanism according to claim 3, in which the fastener screw is disengageable from the token counter and in which the token is removable from the mounting means, while the vending lock remains operatively mounted upon the common mounting means and while the fastener screw is disengaged.

11. A token accepting mechanism, comprising;
(a) a frame having a pair of elongate upright side panels;
(b) means securing the side frames rigidly to each other and in positions spaced from and generally parallel to each other;
(c) a token counter mounted between and within the side frames;
(d) a token acceptor cover positioned over the top of the token counter, the cover precluding accessibility to the token counter from the top of the frame;
(e) cover retainer means in the frame and positively engagable with the cover for retaining the cover to the frame in a pre-determined position atop the token counter;
(f) manually manipulatable means in the cover for locking the cover in the retainer means; and
(g) an access port in an end of the frame, the cover locking means being operably accessible and manually inoperably renderable through the access port, for removal of the cover from the cover retainer means and the frame and from atop of the counter.

12. A token accepting mechanism, comprising:
(a) a frame having a pair of elongate upright side panels;
(b) means securing the side frames rigidly to each other and in positions spaced from and generally parallel to each other;
(c) a token counter mounted between and within the side frames;
(d) a token acceptor cover positioned over the top of the token counter, the cover precluding accessibility to the token counter from the top of the frame;
(e) means in the frame for retaining the cover in a predetermined position atop the token counter;
(f) means in the cover for locking the cover in the retainer means;
(g) an access port in an end of the frame, the cover locking means being accessible and inoperably renderable through the access port, for removal of the cover from the frame and from atop of the counter; and
(h) a rigid panel mounted to and between the side frames, said rigid panel being part of said frame securing means and being atop the access port and having therein at least a part the means for locking of the cover.

13. A mechanism according to claim 12, in which the panel includes a groove as part of the lock means and the cover includes a tongue extending through the groove as part of the lock means, with the tongue being lockable in the groove.

14. A mechanism according to claim 13, including a cross pin extending through the cover tongue for locking the cover to the frame.

15. A mechanism according to claim 14, in which the pin is a spring pin which is self-retaining upon the cover tongue and which is manually removable therefrom.

16. A mechanism according to claim 13, in which that part of the tongue which extends through the groove is covered by the panel.

17. A mechanism for accepting a token and for vending an article upon acceptance of proper token, comprising:

(a) a frame having therein means for vending an article;

(b) a lock mechanism in said frame and operatively connected to said vending means for locking said vending means;

(c) a token counter mounted to the frame and operatively connected to the lock mechanism for crediting tokens and for rendering said lock mechanism inoperative upon crediting of a predetermined quantity of tokens;

(d) a token accepting cover having therein as an integral structural feature, means for identifying a token and for feeding tokens into said token counter;

(e) retainer means in said frame for positively retaining said cover to said frame in a position atop of said token counter and said lock mechanism; and (f) releasing means manipulatable and operable for releasing said cover from positive retention in said retaining means, said cover when released being removable from said retainer means and said frame while said vending means, lock mechanism and token counter remain operative, for providing access from the top of said frame into such operative vend means, lock mechanism and token counter.

18. A mechanism according to claim 17, in which the cover includes therein a coin return and a coin return tray which are integral with the cover and releasable with the cover for providing said access.

19. A mechanism according to claim 17, in which the cover is slidable in the frame and atop of the token counter, to a position in which it is removable from the frame.

20. A mechanism according to claim 17, in which said releasing means comprises a spring pin in the cover, said spring pin being manually removable.

21. A token accepting mechanism comprising:

(a) a frame;

(b) a token counter mounted within and to the frame;

(c) a cover having therein means for identifying and feeding a proper token to the token counter;

(d) a tongue and groove structure retaining the cover to the frame, one of the tongue and groove being in the frame, and the other of the tongue and groove being in the cover; and (e) means for locking the tongue and groove together.

22. A mechanism according to claim 21, in which the cover has on first and second sides and on a first end thereof, one of the tongue and groove structure, and the frame has on first and second sides and centrally along the length thereof, the other and complemental of the tongue and groove structure, the cover and frame being slidable with respect to each other and along the length of the frame for retaining engagement of the tongue and groove structure.

23. A mechanism according to claim 22, in which the groove structure on each respective side includes inner and outer retainers spaced from one another along the length of the frame, the respective side tongue structures being insertable into the frame and against the respective inner retainers and then being slidable along the length of the frame and the inner retainers to a position between the inner and outer retainers.

24. A mechanism according to claim 22, in which the locking means is directly operable upon the first end of the cover.

25. A mechanism according to claim 21, in which the locking means comprises a spring pin manually placeable into and removable from a pin holder in the tongue structure.

26. A token actuatable vend mechanism comprising:

(a) a frame;

(b) an access port in the frame;

(c) means for mounting the frame in a vending machine with the access port being enclosed and covered by the machine;

(d) means in the frame for vending a goods;

(e) a token counter mounted in the frame and operatively connected to the vending means for controlling the vending means;

(f) retainer means in said frame for retaining a token acceptor;

(g) a token acceptor mounted in the retainer means and atop of the token counter; and (h) means for locking the token acceptor in the retainer means, said token acceptor lock means being inoperably renderable directly from the access port for removal of the token acceptor from the retainer means and the frame.

* * * * *